US008413865B2

(12) United States Patent
Mandel et al.

(10) Patent No.: US 8,413,865 B2
(45) Date of Patent: Apr. 9, 2013

(54) WIRE GUIDE FOR AN AUTOMATIC STAPLE GUN

(75) Inventors: Steven J. Mandel, New York, NY (US); Pei-Chang Sun, Taichung (TW)

(73) Assignee: Arrow Fastener Co., LLC, Saddle Brook, NJ (US)

( * ) Notice: Subject to any disclaimer, the term of this patent is extended or adjusted under 35 U.S.C. 154(b) by 0 days.

(21) Appl. No.: 12/920,395

(22) PCT Filed: Jan. 8, 2009

(86) PCT No.: PCT/US2009/030410

§ 371 (c)(1), (2), (4) Date: Nov. 15, 2010

(87) PCT Pub. No.: WO2009/111094

PCT Pub. Date: Sep. 11, 2009

(65) Prior Publication Data

US 2011/0049216 A1 Mar. 3, 2011

Related U.S. Application Data

(60) Provisional application No. 61/034,752, filed on Mar. 7, 2008.

(51) Int. Cl.
*B25C 7/00* (2006.01)

(52) U.S. Cl.
USPC ..... 227/30; 227/110; 227/142

(58) Field of Classification Search ..... 227/140, 227/30, 31, 110, 142, 149, 123, 125
See application file for complete search history.

(56) References Cited

U.S. PATENT DOCUMENTS

| | | | | |
|---|---|---|---|---|
| 3,510,043 | A | 5/1970 | Larson | |
| 4,087,035 | A * | 5/1978 | Harmon | 227/120 |
| 4,552,296 | A * | 11/1985 | Sheng | 227/109 |
| 4,693,407 | A * | 9/1987 | Buck et al. | 227/109 |
| 4,805,824 | A * | 2/1989 | Erickson | 227/120 |
| 4,928,867 | A * | 5/1990 | Jensen | 227/7 |
| 5,014,897 | A | 5/1991 | Uuskallio | |
| 5,094,380 | A | 3/1992 | Nasiatka | |
| 5,491,899 | A | 2/1996 | Schliemann et al. | |
| 5,735,444 | A | 4/1998 | Wingert | |
| 5,826,853 | A | 10/1998 | Anello et al. | |
| 5,884,829 | A | 3/1999 | Wingert | |
| 6,082,604 | A | 7/2000 | Dennis | |
| 6,131,788 | A * | 10/2000 | Marks | 227/132 |
| 6,393,711 | B1 * | 5/2002 | Freund | 33/626 |

(Continued)

FOREIGN PATENT DOCUMENTS

WO WO2009/111094 A1 9/2009

OTHER PUBLICATIONS

Chinese Office Action for corresponding Application No. 200980108627.6, mailed Nov. 16, 2011, 4 pages.

(Continued)

*Primary Examiner* — M. Alexandra Elve
*Assistant Examiner* — Eyamindae Jallow
(74) *Attorney, Agent, or Firm* — Brooks Kushman P.C.

(57) ABSTRACT

A wire guide apparatus for a powered staple gun is adapted to be housed in a low-profile housing at the front end of the staple gun, forward of the safety and staple driver.

20 Claims, 4 Drawing Sheets

U.S. PATENT DOCUMENTS

| | | | | |
|---|---|---|---|---|
| 7,011,242 | B2 | 3/2006 | Barlow et al. | |
| 7,290,693 | B2 * | 11/2007 | Cheng | 227/29 |
| 7,540,400 | B2 * | 6/2009 | Zins et al. | 227/8 |
| 7,562,801 | B2 | 7/2009 | Pelletier et al. | |
| 7,594,598 | B2 * | 9/2009 | Chen et al. | 227/8 |
| 7,739,807 | B2 * | 6/2010 | Grant | 33/645 |
| 8,240,535 | B2 * | 8/2012 | Shor | 227/140 |
| 2007/0039994 | A1 * | 2/2007 | Pelletier et al. | 227/132 |
| 2007/0158383 | A1 * | 7/2007 | Cheng | 227/30 |
| 2010/0140316 | A1 * | 6/2010 | Tanimoto et al. | 227/132 |

OTHER PUBLICATIONS

Canadian Office Action for corresponding Application No. 2,717,501, mailed Dec. 15, 2011, 3 pages.

China Office Action for corresponding Application No. 200980108627.6, mailed Jun. 15, 2012, 6 pages.

* cited by examiner

WIRE GUIDE FOR AN AUTOMATIC STAPLE GUN

BACKGROUND OF THE INVENTION

1. Field of the Invention

The invention is directed to the field of automatic staple guns, and more particularly to a wire guide element for positioning a staple in the gun with respect to a wire or cable to be stapled.

2. Description of Related Art

Staple guns are well known hand-held tools adapted to drive staples into a workpiece. Arrow Fastener Company manufactures and sells numerous models of such devices, including the non-powered staple gun sold under the T-50® brand name, and more recently introduced powered models, such as the cordless CT-50™.

It is known to provide a wire guide for a staple gun, as disclosed for example in U.S. Pat. No. 5,884,829, assigned to the Arrow Fastener Company and incorporated herein by reference. A wire guide is an element having a surface that fits around a wire or cable, positioning the staple gun so that the staple is driven reliably over the wire or cable to attach it to the work piece. Surfaces on either side of the wire or cable are typically positioned against the surface to be stapled.

As staple gun technology has advanced, a number of desirable features have been added. An LED positioned near the staple driver and adapted to directly illuminate the surface being stapled is very popular. It is also known to equip staple guns with passive safety features. In the CT 50™ by Arrow Fastener Company, for example, the safety element is a planar vertically oriented element that protrudes from the bottom of the gun in front of the driver. The planar element actuates a switch, so that the gun can fire only when the safety is fully depressed, i.e., when the bottom of the gun is positioned against a surface to be stapled.

Both the LED and safety are advantageously positioned in front of the staple driver, so as not to interfere with the operation of the gun, and especially with the operation of the staple driver. To provide a wire guide in combination with these elements poses a technical challenge because the available space in front of the staple driver is limited.

Thus, one object of the invention is to provide a wire guide for a staple gun in a low profile housing at the front end thereof, that can be retracted by the user and which can be combined with other elements, such as an LED and a safety, in a space-saving manner.

BRIEF SUMMARY OF THE INVENTION

In one aspect, the invention is a wire guide apparatus provided on a staple gun having a staple driver at a front end thereof (such as, without limitation, the CT-50™ model made by Arrow Fastener Corporation). A housing for the wire guide is positioned forward of the staple driver. The housing houses a cam switch, a cam shaft and a cam, and the cam switch can be moved to rotate the cam. A substantially planar wire guide in the housing has a first cutout adapted to be positioned over a wire or cable, and a second cutout adapted to receive the cam. The cam is positioned to be rotated within the second cutout to move the wire guide between a first position, in which the first cutout is not extended from the staple gun and a second position, in which the first cutout is extended from the staple gun.

In preferred embodiments, the staple gun is provided with a substantially planar safety element having an aperture through which the cam shaft passes, the aperture being elongated so that the safety element can slide in the vertical direction in the housing.

In still more preferred embodiments, the housing is provided with a light emitting diode.

DETAILED DESCRIPTION OF THE INVENTION

Unless stated otherwise, directions are used herein with reference to the normal orientation of the staple gun. Thus, the handle is at the top of the device, and the direction toward the top is "up." The staple driver (not shown) is oriented vertically, located toward the "front" of the gun; staples come out of the "bottom" of the staple gun, and the direction toward the bottom is "down," etc.

Figure 1:
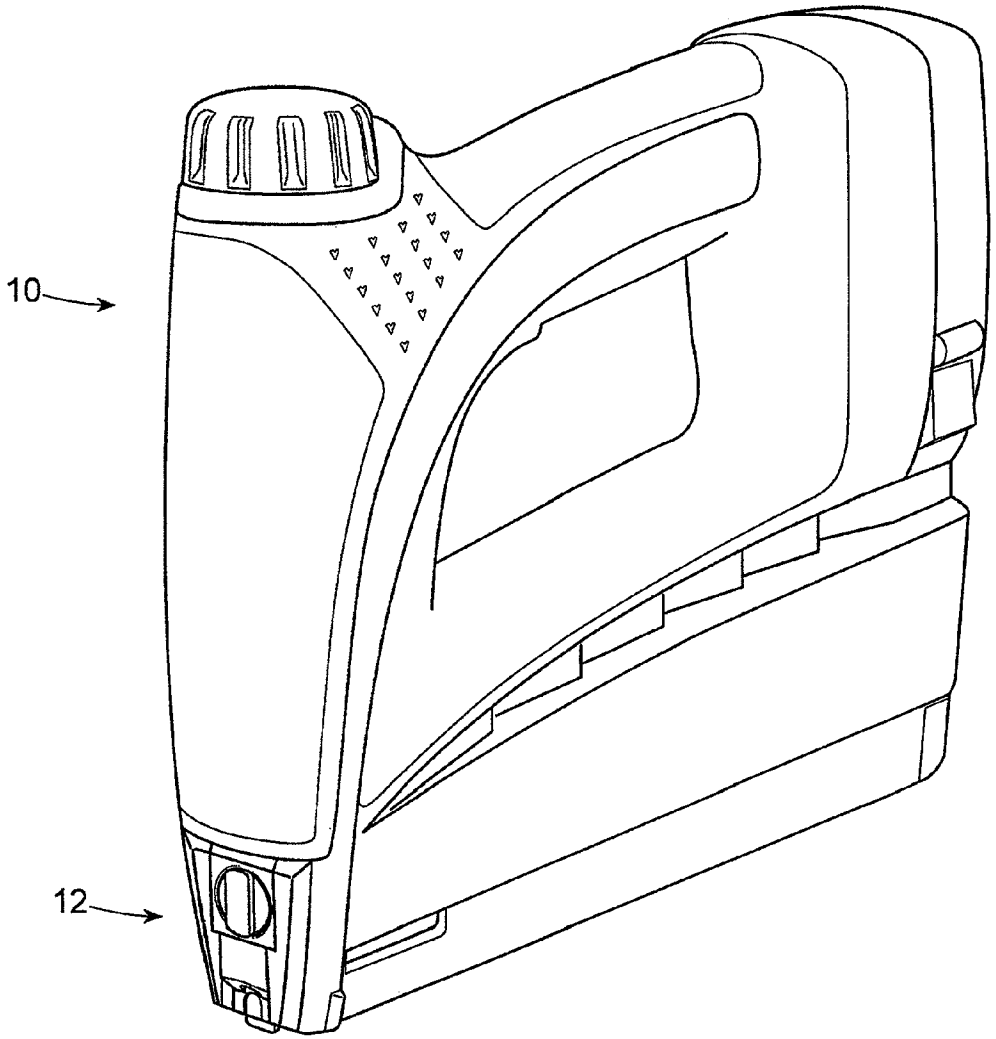
FIG. 1 is a perspective view of a staple gun incorporating a wire guide apparatus according to the invention.

In the embodiment shown in FIG. 1, the staple gun 10 includes insert 12, located at the front end of the staple gun at the bottom. The staple driver, sometimes referred to as the "knife" (not shown), is a vertical element located behind the insert that drives the staples out of the gun when the trigger is actuated.

Figure 2:
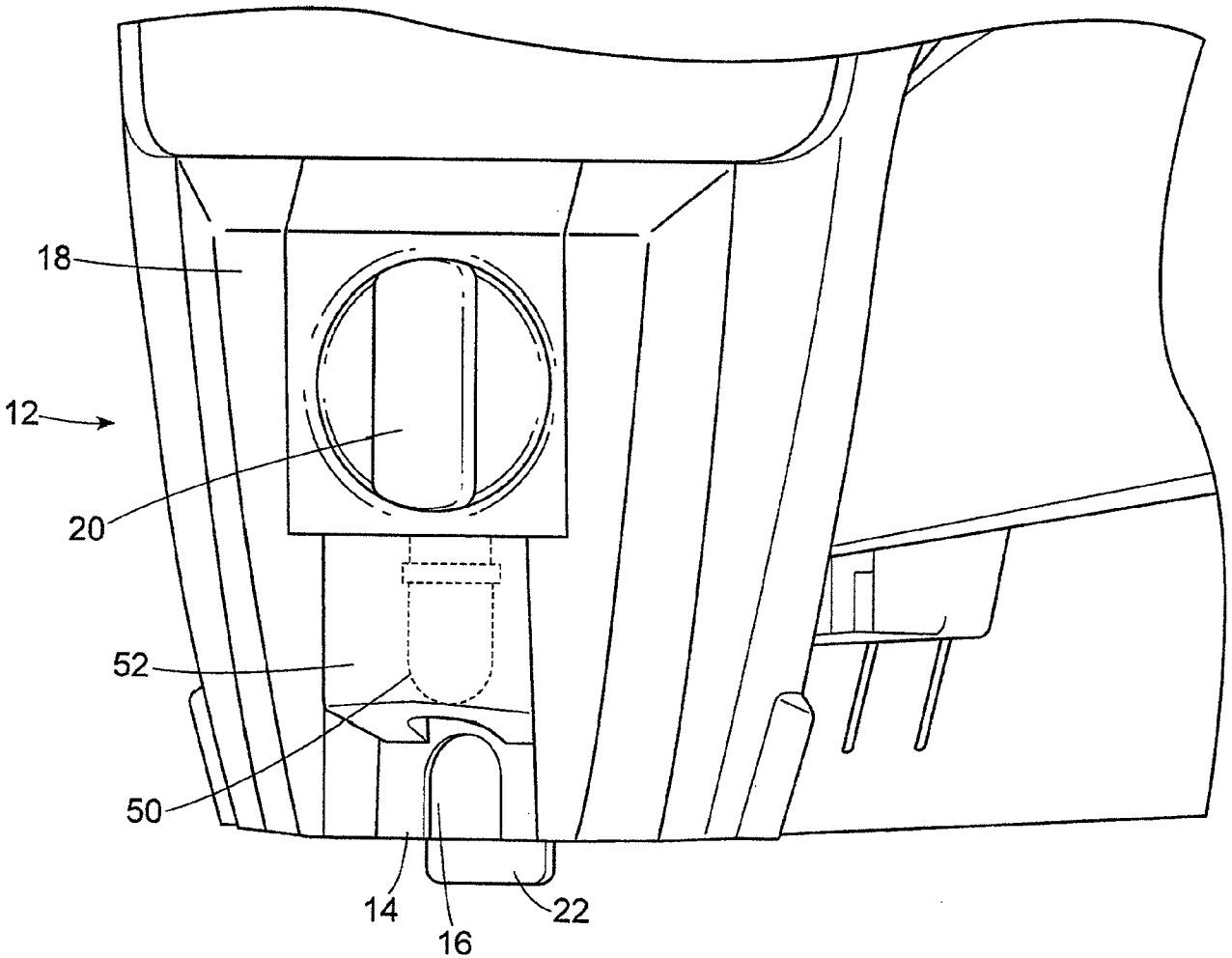
FIG. 2 is a detail view of the wire guide housing.
Figure 3:
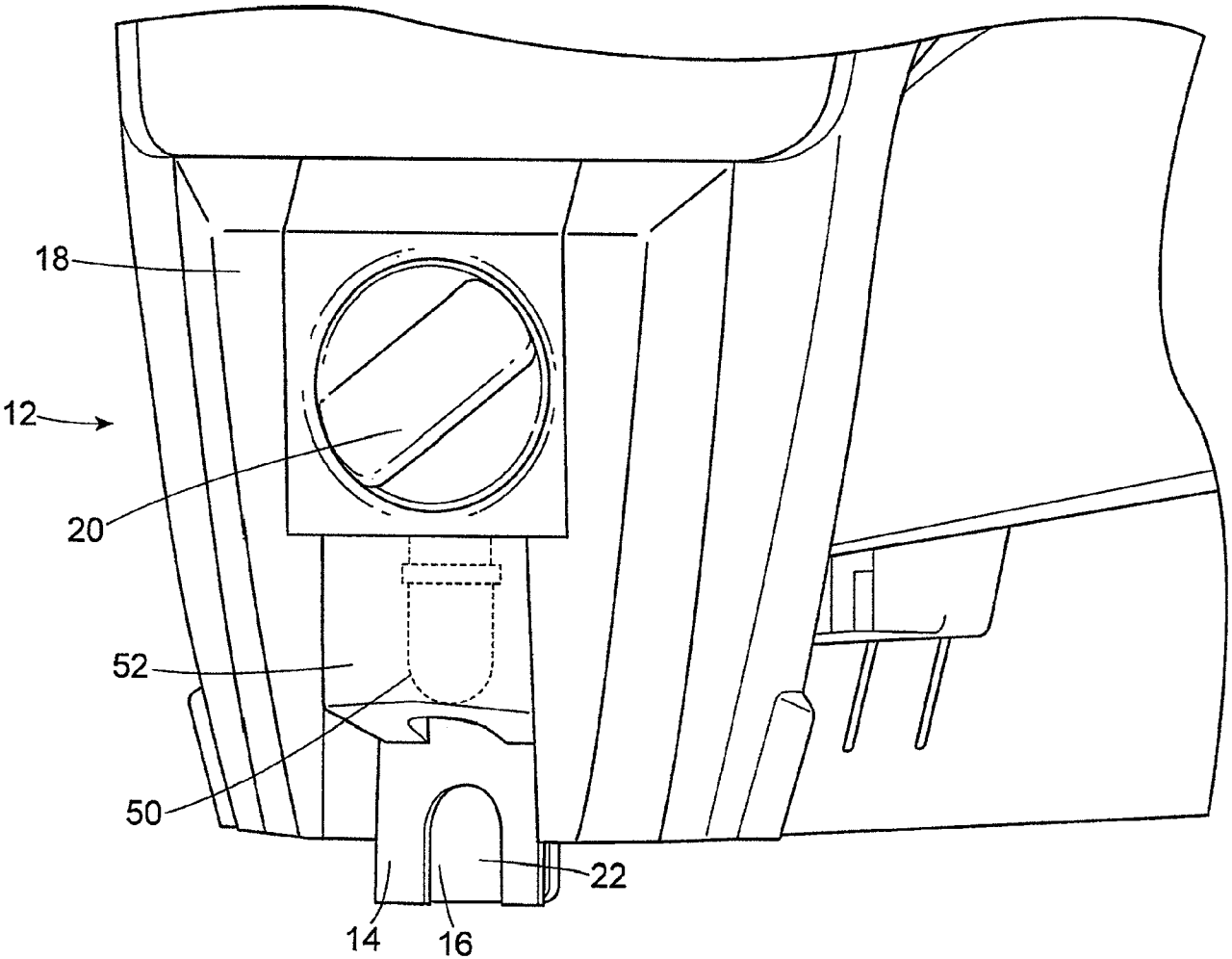
FIG. 3 is a detail view of the wire guide housing with the wire guide in the extended position.

A seen in the detail view of FIG. 2, insert 12 includes a housing 18, which may be provided with slots to guide a wire guide 14 and safety element 22. The housing also includes space for cam switch 20.

The cam switch may be any shape provided that it can be configured to move wire guide 14. In a preferred embodiment, at least a portion of the cam switch is arcuately shaped, and the cam is seated in a correspondingly shaped arcuate recess in the housing. For example, the switch can be circular and seated in a circular recess, as shown in FIG. 2.

In the embodiment shown, the cam switch is rotatable between a first position and a second position, corresponding to respective first and second positions of wire guide 14, so that the wire guide is either not extended from the bottom of the staple gun, as shown in FIG. 2, or extended from the bottom of the staple gun, and ready to be used. This enables convenient use of the staple gun without the wire guide, such as with nails (typically ⅝" nails), or with staples, in a context where it is not desired to staple cable or wire. In those instances, the wire guide is set to a retracted position.

The housing may have an open back and a central channel on the front of the housing to receive the cam switch 20 and a sub housing 52 holding an LED 50 in a compact low-profile manner. "Low profile" in this context means less than 25 mm, preferably less than 20 mm and most preferably less than 15 mm total height of the housing from back to front.

The wire guide element 14 is preferably planar so that it can be accommodated in a low profile housing. The wire guide comprises a first cutout 36 (shown in FIG. 4) with an open end adapted to be positioned over a wire or cable when in use, and a second cutout 32 adapted to receive the cam 28. The second cutout has a closed surface 34 (seen in FIG. 4) on one side of the cam which prevents rotation of the cam past surface 34 in either clockwise or counter-clockwise directions, while on the opposite side of the cam, the second cutout 32 has room to permit rotation of the cam 28. In the embodiment shown, the side of the second cutout opposite the closed side is open, and the cam can be rotated a little more than 180 degrees from the first position to the second position.

The closed surface 34 of the second cutout may be provided with rounded corners so that the cutout is slightly wider at the closed end than at the open end. This facilitates positioning the bearing surface 30 of the cam in the corners of the second cutout to perform a locking function as described below.

Figure 4:
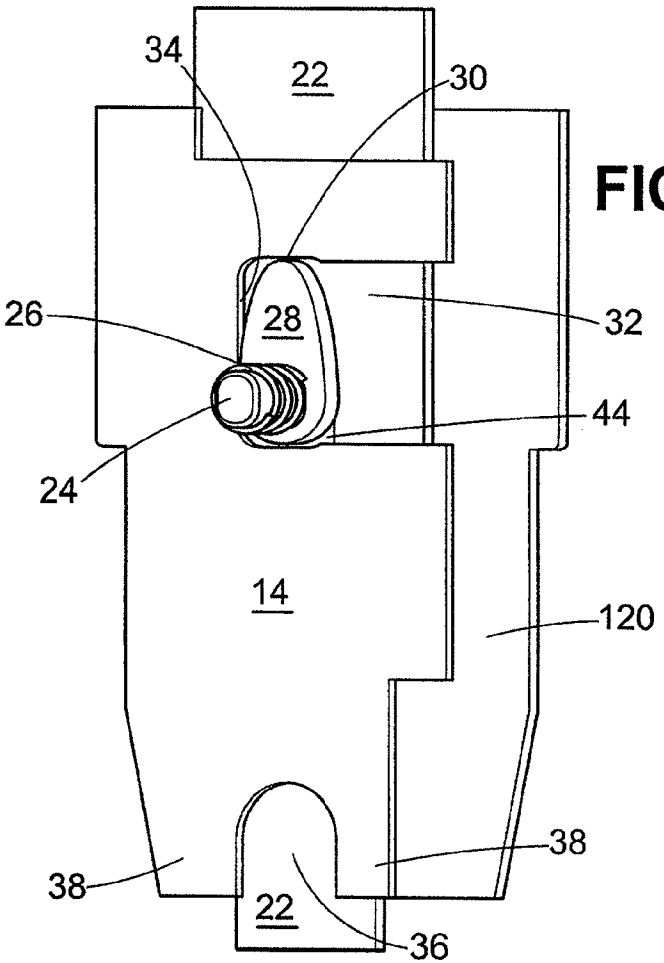
FIG. 4 is a detail view of internal elements of the wire guide camming mechanism.

The operation of a cam mechanism for a wire guide according to the invention is illustrated in connection with FIG. 4. In FIG. 4, the cam switch has been removed to reveal cam shaft 24, spring 26 and cam 28, which are assembled on back plate 120. The cam may have any shape suitable to the purpose, including the ovoid shape shown in the preferred embodiment of FIG. 4. In the retracted or first position, bearing surface 30 of the cam 28, is urged against the top surface of the second cutout 32. To lock the wire guide in the first (retracted) position, the cam is rotated a little past the longitudinal axis of the wire guide, so that the longitudinal axis of the cam forms a small angle with respect to the longitudinal axis of the wire guide 14, inclining slightly toward the closed side of the second cutout. A similar locking functionality is obtained in the second (extended) position of the wire guide, where the cam is rotated a little more than 180 degrees, so that bearing surface 30 of the cam is urged against the bottom surface of the second cutout. By lodging the bearing surface 30 of the cam in the corner of the cutout, so that the longitudinal axis of the cam is at an angle with respect to a longitudinal axis of the wire guide, the wire guide cannot be moved by applying force in the direction of arrow F, unless the cam is moved again by moving cam switch 20. This is shown best in FIG. 5.

The locking mechanism is improved by widening the corners of the closed surface 34 in the second cutout, such as by rounding the corners. The dimensions of the second cutout are determined by how large a cam is required to make the wire guide protrude from the staple gun by the desired amount in the second position. Although not critical, the vertical height of the second cutout may be in a range of about 8.0 mm to about 11.0 mm, and the distance between the top and bottom walls at the closed end, i.e., at the widest point, may be about 0.1 mm to about 0.5 mm larger than the distance at the opposite, or open, side of the second cutout.

The first cutout 36 may be formed with prongs 38 defining opposite sides of the first cutout. The distance between the two prongs defining the first cutout is not particularly critical, and may be, for example, in a range of about 6.0 mm to about 8.0 mm. In a working embodiment, a width of 7.0 mm was found to be suitable for this purpose. Likewise, the distance from the top of the cutout to the bottom ends of the prongs is not limited. This distance may conveniently be in a range of about 5.0 to 7.0 mm, for example 6.2 mm. The top of the cutout may be any shape, such as arcuate shape. In the Figures, the top of the cutout is essentially in the shape of a semicircle. The staples ordinarily used with the CT-50™ made by the Arrow Fastener Company will also be used with a model adapted with the wire guide according to the invention, and the size of the first cutout may be designed accordingly.

Figure 5:
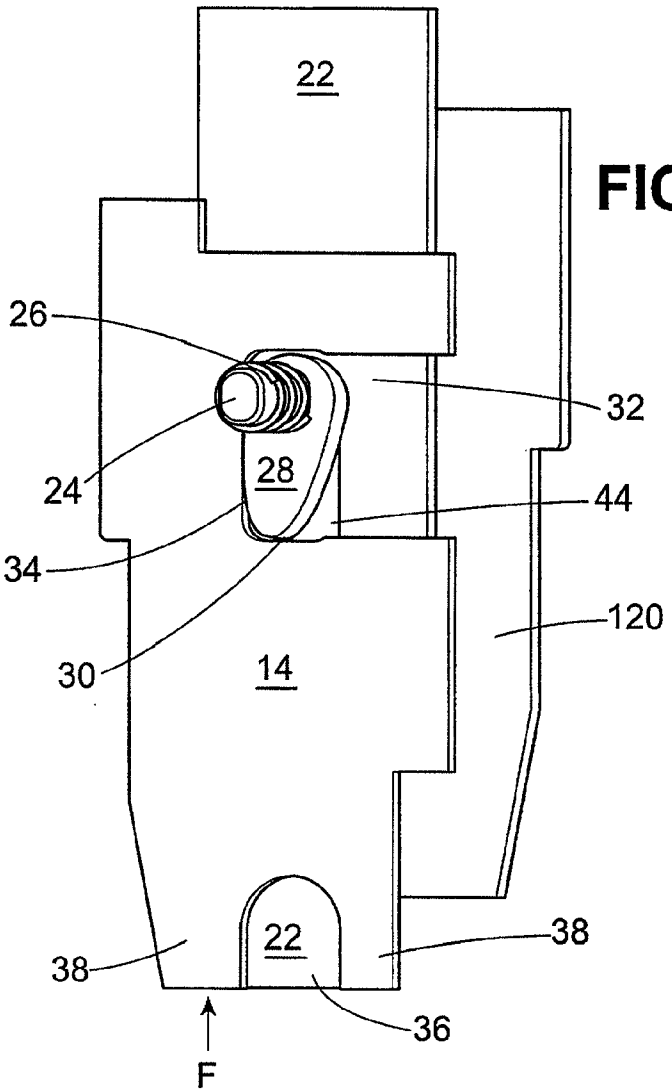
FIG. 5 is a detail view of internal elements of the wire guide camming mechanism in the extended and locked position.

In embodiments, the staple gun may be provided with a safety element 22 which is operatively connected to elements in the body of the gun in a known manner (not shown) so that the gun cannot fire unless the safety is depressed. In order to accommodate operation of the safety 22 with a wire guide and housing as described herein, safety 22 is provided with an aperture 44 through which cam shaft passes. The aperture is somewhat elongated, allowing the safety element to move up and down without affecting the wire guide. (Only a portion of aperture 44 is seen in FIG. 4 and FIG. 5, because the view is obscured by the wire guide.)

FIG. 2 depicts a preferred embodiment in which housing 18 is provided with a central channel which houses the cam switch 20, as well as LED sub housing 52, including LED 50, as well as accommodating the wire guide and cam elements described above. All of these elements can be provided in a low profile format, having a height less than 20 mm, preferably less than 15 mm, which permits the safety 22, the LED 50 and the wire guide 14 all to be positioned in close proximity to the staple driver.

The above description of the preferred embodiments, in connection with the drawings, is for illustration purposes, and is not to be deemed limiting of the invention, which is defined by the appended claims.

What is claimed is:

1. A wire guide apparatus for a staple gun having a staple driver at a front end thereof, the apparatus comprising:

a housing positioned on the front end of the staple gun forward of the staple driver;

the housing holding a cam switch, a cam shaft and a cam, the cam switch being movable to rotate the cam; and a substantially planar wire guide having a first cutout adapted to be positioned over a wire or cable and a second cutout adapted to receive the cam;

wherein the cam is movable within the second cutout to move the wire guide linearly from a first position, in which the first cutout is not extended from the staple gun, to a second position in which the first cutout is extended from the staple gun;

wherein at least a portion of the cam switch has an arcuately shaped portion received in a correspondingly shaped arcuate recess in the housing;

wherein the cam switch is rotatable between a first position, in which a bearing surface of the cam is urged against an upper surface of the second cutout in the wire guide, and a second position, in which the bearing surface of the cam is urged against a lower surface of the second cutout in the wire guide;

wherein said first and second positions of the cam switch and cam correspond to the first and second positions of the wire guide;

wherein, in the first position and the second position, the longitudinal axis of the cam is at an angle with respect to a longitudinal axis of the wire guide to lock the wire guide in the first position and the second position; and wherein, in the first position and the second position, the longitudinal axis of the cam cooperates with the wire guide to lock the guide in the first position and the second position without an additional locking mechanism.

2. The wire guide apparatus of claim 1, wherein the staple gun is provided with a substantially planar safety element having an aperture through which the cam shaft passes, the aperture being elongated so that the safety element can slide in the housing without affecting the wire guide.

3. The wire guide apparatus of claim 1, further comprising a light emitting diode positioned forward of the wire guide.

4. The wire guide apparatus of claim 1, wherein the housing has an open back, a forward slot to receive the wire guide, a rear slot to receive a planar safety element, and a central channel on the front of the housing to receive the cam switch, a light emitting diode (LED) and an LED subhousing in a low profile manner.

5. The wire guide apparatus of claim 1 wherein the cam switch comprises a rotary switch.

6. The wire guide apparatus of claim 1 wherein the second cutout has a closed surface on one side of the cam to prevent rotation of the cam past the closed surface.

7. The wire guide apparatus of claim 6 wherein the closed surface of the second cutout limits rotation of the cam to less than a full rotation.

8. The wire guide apparatus of claim 6 wherein the closed surface of the second cutout permits rotation of the cam greater than 180 degrees.

9. The wire guide apparatus of claim 6 wherein the second cutout has an open end spaced apart from the closed surface; and wherein the second cutout is provided with rounded corners so that the second cutout is wider adjacent the closed surface than at the open end for receipt of a bearing surface of the cam in the rounded corners.

10. The wire guide of claim 9 wherein the cam switch is rotatable between the first position for retraction of the wire guide, and the second position for extension of the wire guide; and wherein the cam is rotated past center in the second position such that if a force is applied upon the wire guide in a direction from extension to retraction, the wire guide translates, thereby rotating the cam bearing surface toward the closed surface of the second cutout, and thereby preventing rotation of the cam away from the closed surface, and consequently preventing retraction of the wire guide.

11. The wire guide of claim 10 wherein the cam locks the wire guide in the extended position when the cam is rotated to the second position.

12. The wire guide of claim 9 wherein the cam switch is rotatable between the first position for retraction of the wire guide, and the second position for extension of the wire guide; and wherein the cam is rotated in the second position inclined toward the closed surface such that if a force is applied upon the wire guide in a direction from extension to retraction, the wire guide translates, thereby rotating the cam bearing surface toward the closed surface of the second cutout, and thereby preventing rotation of the cam away from the closed surface, and consequently preventing retraction of the wire guide.

13. The wire guide of claim 12 wherein the cam locks the wire guide in the extended position when the cam is rotated to the second position.

14. A staple gun comprising:

a housing;

a staple driver oriented at an end of the housing;

a rotary switch mounted for rotation on the housing;

a cam mounted for rotation on the housing, the cam being connected to the rotary switch so that rotation of the rotary switch rotates the cam; and a wire guide mounted to the housing for translation relative to the housing, the wire guide having a first cutout adapted to be positioned over a wire or cable and a second cutout sized to receive the cam;

wherein the rotary switch is rotatable between a first position whereby a bearing surface of the cam is urged against an upper surface of the second cutout in the wire guide for retraction of the wire guide, and a second position whereby the bearing surface of the cam is urged against a lower surface of the second cutout in the wire guide for extension of the wire guide; and wherein the cam is rotated past center in the second position such that if a force is applied upon the wire guide in a direction from extension to retraction, the wire guide translates, thereby rotating the cam bearing surface toward a closed surface of the second cutout, and thereby preventing rotation of the cam away from the closed surface, and consequently preventing retraction of the wire guide.

15. The staple gun of claim 14 further comprising a substantially planar safety element having an aperture through which the cam shaft passes, the aperture being elongated so that the safety element can slide in the housing without affecting the wire guide.

16. The staple gun of claim 14 further comprising a light emitting diode (LED) positioned forward of the wire guide.

17. The wire guide of claim 14 wherein the cam locks the wire guide without an additional locking mechanism.

18. A staple gun comprising:

a housing;

a staple driver oriented at an end of the housing;

a rotary switch mounted for rotation on the housing;

a cam mounted for rotation on the housing, the cam being connected to the rotary switch so that rotation of the rotary switch rotates the cam; and a wire guide mounted to the housing for translation relative to the housing, the wire guide having a first cutout adapted to be positioned over a wire or cable and a second cutout sized to receive the cam;

wherein the rotary switch is rotatable between a first position whereby a bearing surface of the cam is urged against an upper surface of the second cutout in the wire guide for retraction of the wire guide, and a second position whereby the bearing surface of the cam is urged against a lower surface of the second cutout in the wire guide for extension of the wire guide; and wherein the cam is rotated in the second position inclined toward the closed surface such that if a force is applied upon the wire guide in a direction from extension to retraction, the wire guide translates, thereby rotating the cam bearing surface toward a closed surface of the second cutout, and thereby preventing rotation of the cam away from the closed surface, and consequently preventing retraction of the wire guide.

19. The staple gun of claim 18 further comprising a substantially planar safety element having an aperture through which the cam shaft passes, the aperture being elongated so that the safety element can slide in the housing without affecting the wire guide.

20. The wire guide of claim 18 wherein the cam locks the wire guide without an additional locking mechanism.

* * * * *